US006456810B1

(12) United States Patent
Deguchi et al.

(10) Patent No.: US 6,456,810 B1
(45) Date of Patent: Sep. 24, 2002

(54) DEVELOPING CARTRIDGE HAVING TONER AGITATOR AGITATING TONERS IN TONER CONTAINER AND TRANSFERRING TONER TO DEVELOPING CHAMBER

(75) Inventors: Hideaki Deguchi; Masahiro Ishii; Tsutomu Suzuki, all of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/612,368

(22) Filed: Jul. 7, 2000

(30) Foreign Application Priority Data

Jul. 14, 1999 (JP) ..... 11-200390
Sep. 28, 1999 (JP) ..... 11-273914

(51) Int. Cl.[7] ..... G03G 15/08
(52) U.S. Cl. ..... 399/254; 399/27
(58) Field of Search ..... 399/254, 255, 399/256, 258, 27, 113, 111; 222/DIG. 1, 167; 430/120; 366/241, 279, 292, 293, 309, 329.1, 329.2, 330.1

(56) References Cited

U.S. PATENT DOCUMENTS 5,612,770 A * 3/1997 Bandai et al. ..... 399/254
5,655,175 A * 8/1997 Oshida ..... 399/27
5,655,195 A * 8/1997 Ichikawa et al. ..... 399/263
5,913,097 A * 6/1999 Nakano et al. ..... 399/256
6,047,141 A * 4/2000 Miyaoka et al. ..... 399/27

FOREIGN PATENT DOCUMENTS

JP 03-175471 * 7/1991
JP 05-273856 * 10/1993
JP 06-035321 * 2/1994
JP 10-177295 * 6/1998
JP 10-319701 * 12/1998

* cited by examiner

*Primary Examiner*—Sophia S. Chen
(74) *Attorney, Agent, or Firm*—Oliff & Berridge, PLC

(57) ABSTRACT

A developing cartridge including a developing housing, a toner container positioned beside the developing housing and formed with an opening. First and second agitators are disposed in the toner container and are rotatable about an axis extending in parallel with the opening for transferring the toner in the toner container to the developing housing through the opening. The first blade has a length equal or greater than the length of the opening, and the second blade has a length smaller than the length of the first blade and is positioned at the lengthwise center of the opening. The second blade is positioned forwardly of the first blade in the rotational direction of these blades.

28 Claims, 12 Drawing Sheets

DEVELOPING CARTRIDGE HAVING TONER AGITATOR AGITATING TONERS IN TONER CONTAINER AND TRANSFERRING TONER TO DEVELOPING CHAMBER

BACKGROUND OF THE INVENTION

The present invention relates to a developing cartridge, and more particularly, to the device having a toner container and a developing chamber and in which a toner agitator is provided in the toner container for agitating toners in a toner container and for transferring the toner to the developing chamber. The present invention also relates to a process cartridge provided with the developing cartridge, and to an image forming device provided with the process cartridge.

There has been provided an image forming device having a developing cartridge which uses a non-magnetic single component type developing agent (hereinafter, simply referred to as "toner"). In such type of the conventional image forming device, in the developing chamber, a toner layer thickness regulation blade is in pressure contact with a developing roller carrying thereon the toner. Thus, a thin toner layer is formed on an outer peripheral surface of the developing roller. The toner of the toner layer is transferred onto a photosensitive body which carries an electrostatic latent image, so that a visible toner image corresponding to the electrostatic latent image is formed. The toner image is then transferred onto a printing sheet, and the toner image on the sheet is fixed.

A printable width in a widthwise direction of the printing sheet is determined by a width of the thin toner layer on the developing roller, the width being in an axial direction of the developing roller, that is, a width of the pressure contact portion between the toner layer thickness regulation blade and the developing roller. Normally, in the conventional developing cartridge, the width of the blade is configured greater than the width of a maximum size printing sheet, and an axial length of the developing roller is greater than the width of the blade.

However, a maximum size printing may not be often performed. Therefore, toner at both axial end portions of the developing roller may not be frequently used, and accordingly, such toner are repeatedly passed through the pressure contact portion under pressure between the blade and the developing roller.

The conventional non-magnetic single component type toner includes base particles and external additives such as silica, alumina and titanium oxide. Due to the repeated pressurization of the toner, the external additives may be embedded into the base particles, and as a result, fluidity of the toner may be degraded, and the degraded toners are stayed at each end portion of the developing chamber. Consequently, imaging quality may be gradually degraded from at widthwise end portions of the printing sheet.

An opening is formed at a boundary between the developing chamber and the toner container positioned beside the developing chamber. A toner transfer member or agitator is rotatably provided in the toner container, and free end of the agitator is protrudable into the opening. Upon rotation of the agitator, toner in the toner container is delivered to the developing chamber through the opening.

In order to avoid long term stay of the toner at the axially end portions of the developing roller, proposed is a developing cartridge in which a width of the opening is made approximately equal to the width of the developing chamber, so that the width of the opening is equal to or greater than the printable width, and a length of the agitator (the length being extending in the widthwise direction of the printing sheet) is made substantially equal to the width of the opening.

However, with this arrangement, even though the toner circulation occurs in a direction of an array of the developing chamber and the toner container. However, toner circulation along the axial direction of the developing roller, i.e., in the widthwise direction of the developing chamber may not easily occur. Therefore, it would be impossible to prevent the toner at the axially end portions of the developing roller from being stayed or rested thereat and degraded.

In case where the width of the opening is made equal to the printable width, if the toner is not uniformly delivered to the developing chamber in the widthwise direction of the opening, toner may not be sufficiently supplied onto the developing roller, and a variation in image density may occur such as formation of linear scratches extending in the longitudinal direction of the printing sheet at the toner shortage area of the developing roller.

SUMMARY OF THE INVENTION

In order to avoid this problem, provision of an additional agitator in the developing chamber may be conceivable. With such an arrangement, toner circulation in the developing chamber in the widthwise direction thereof can be improved so as to avoid stay of toner at each end portion of the developing chamber. However, additional driving system is required for driving a additional agitator, and intricate structure results, and production cost may be increased.

Another proposal is made in which a lower end of the opening is lowered, i.e., an upper end of a partitioning wall is lowered, the partitioning wall partitioning the toner container from the developing chamber in order to promote toner circulation between the toner container and the developing chamber. That is, the toner delivered from the toner container into the developing chamber can be returned back to the toner container because of own gravity of the toner because of a low level damming of the partitioning wall. However, with this structure, toner delivering amount to the developing roller may be decreased, and a fogging may occur in the printed image if a large area printing is performed.

Still another proposal is made in which the agitator in the toner container is formed of a highly flexible thick PET sheet to forcibly push the toner in the toner container to the developing chamber in order to greatly enhance toner transferring efficiency to the developing chamber. After the agitator is moved past the opening, the forcibly delivered toner into the developing chamber can be easily returned back to the toner container because greater amount of toner has been supplied into the developing chamber. However, with this structure, loud noise is generated when the deformation of the PET sheet is released, for example, when the deformed PET sheet passes through the opening.

It is therefore, an object of the present invention to overcome the above described drawbacks and to provide an improved developing cartridge capable of providing sufficient toner circulation in the widthwise direction of the developing chamber with a simple construction and without decreasing toner transferring amount to the developing roller and without generation of noise.

Another object of the invention is to provide a process cartridge having the above developing cartridge, and to provide an image forming device incorporating therein the process cartridge.

These and other object of the present invention will be attained by providing a developing cartridge including a developing housing, a developing agent container, and an improved developing agent agitating and transferring member. The developing agent container holds therein a developing agent. The developing agent container is connected to and positioned beside the developing housing and is formed with an opening in communication with the developing housing. The opening has a length in a widthwise direction of an image recording sheet. The developing agent agitating and transferring member is rotatably disposed in the developing agent container about a rotation axis for agitating the developing agent in the developing agent container and transferring the developing agent to the developing housing. The developing agent agitating and transferring member includes circulation means for circulating the toner in the developing housing in the widthwise direction thereof.

In one preferred fashion, the circulation means includes means for promoting a transferring efficiency of the developing agent from the developing agent container to the developing housing at a lengthwise center portion of the opening higher than the efficiency at lengthwise end portions of the opening. The developing agent agitating and transfer means includes a first blade rotatable about the rotation axis and having a length equal to or greater than the length of the opening and positioned in alignment with the opening. The promoting means includes a second blade also rotatable about the rotation axis and having a length smaller than the length of the first blade and positioned at the lengthwise center of the opening.

In another preferred fashion, the developing agent agitating and transferring member includes a center shaft, a support member and a flexible blade. The center shaft is rotatable about its axis and is provided in the developing agent container and extends in the widthwise direction of the image recording sheet. The support member is fixed to the center shaft and extends in the widthwise direction of the image recording sheet. The flexible blade has a base end fixed to the support member and a free end in flexible deforming contact with an inner surface of the developing agent container. The flexible blade serves as the circulation means and comprises end blade sections and an intermediate blade section. The end blade sections each has a base end fixed to each longitudinal end of the support member, and has free end in flexible deforming contact with the inner surface of the developing agent container. Each free end is slanted with respect to the support member in such a manner that a radial length between the base end and the free end is gradually increased from a longitudinal end toward a longitudinal center of the support member. The intermediate blade section is positioned between the end blade sections and has a base end fixed to the support member and a free end. Each end section has a maximum radial length at a side closest to the intermediate blade section. The intermediate section has a radial length between the base end and the free end smaller than the maximum radial length.

In another aspect of the present invention, there is provided a process cartridge including a casing, an electrostatic latent image carrying member disposed in the casing, and the above described developing cartridge. The developing cartridge is detachable with respect to the casing.

In still another aspect of the invention, there is provided an image forming device including the above described process cartridge.

BRIEF DESCRIPTION OF THE DRAWINGS

In the drawings:

FIG. 11(*b*) is a plan view showing the first and second agitators as viewed from an arrow H of FIG. 11(*d*) according to the second embodiment;

FIG. 11(*c*) is a plan view showing the first and second agitators as viewed from an arrow I of FIG. 11(*d*) according to the second embodiment;

FIG. 11(*d*) is a side view showing the first and second agitators as viewed from an arrow J of FIG. 11(*c*) according to the second embodiment;

FIG. 12(*b*) is a side view of the first agitator;

DETAILED DESCRIPTION OF THE PREFERRED EMBODIMENTS

Figure 1:
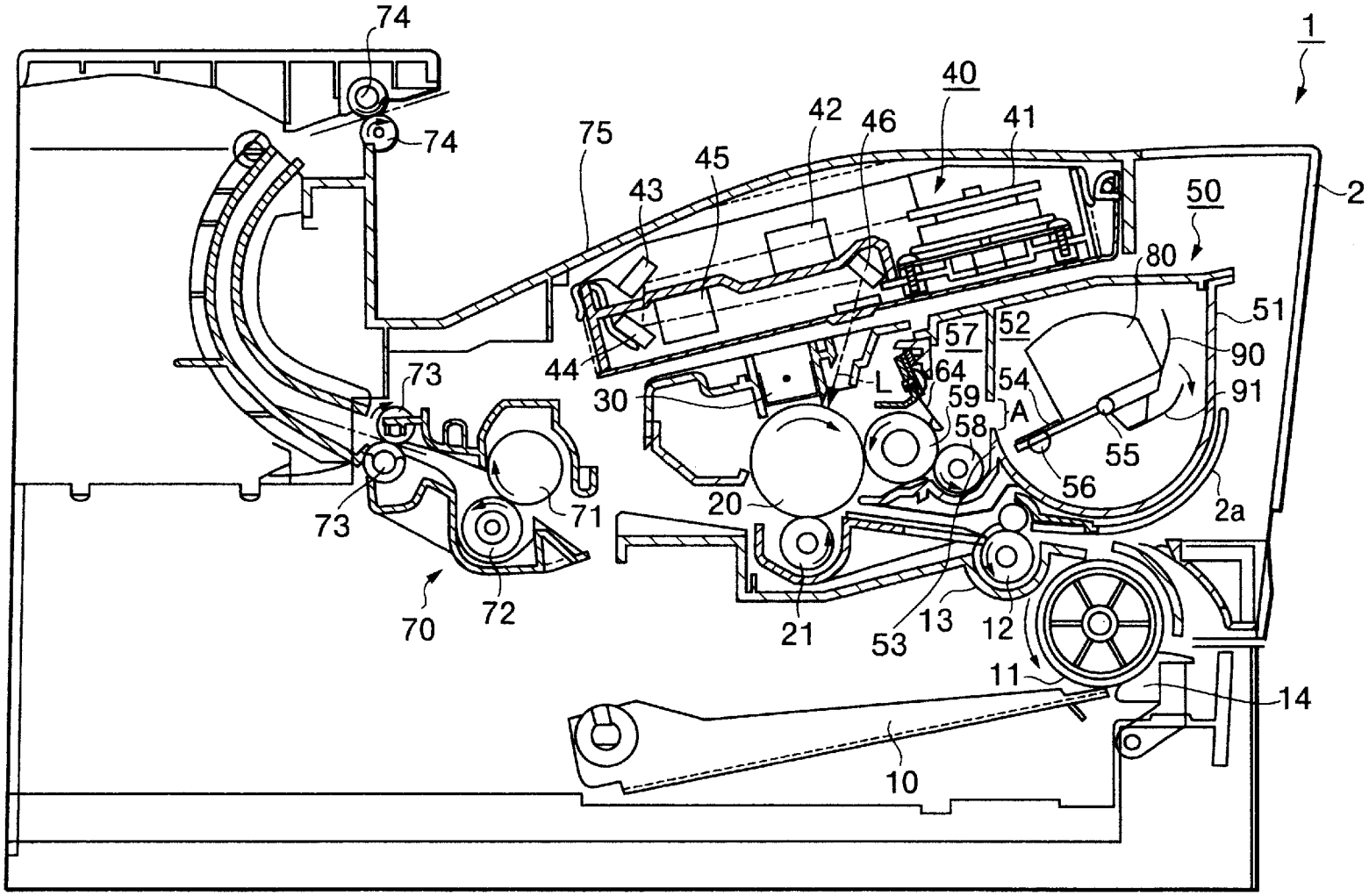
FIG. 1 is a cross-sectional view showing a laser beam printer according to a first embodiment of the present invention.

A laser beam printer 1 according to a first embodiment the present invention is shown in FIG. 1. The laser beam printer 1 includes a case 2, and a feeder unit for supplying sheets (not shown) at the bottom portion of the case 2. The feeder unit includes a friction separation member 14, a sheet supply roller 11, and a sheet pressing plate 10 urged upward by a spring (not shown). The sheet pressing plate 10 presses the sheets upward against the sheet supply roller 11. Rotation of the sheet supply roller 11 separates the upper-most sheet at a position between the sheet supply roller 11 and the friction separation member 14, to supply sheets at a predetermined timing.

A pair of register rollers 12 and 13 are rotatably supported at a position downstream along the pathway which sheets are transported by rotation of the sheet supply roller 11 in the direction indicated by an arrow in FIG. 1. The pair of register rollers 12 and 13 transports sheets at a predetermined timing to a transfer position, which is defined by a photosensitive drum 20 and a transfer roller 21.

The photosensitive drum 20 is rotatably supported on the case 2, and driven to rotate in a direction indicated by an arrow by a drive means (not shown). The photosensitive drum 20 is formed from a positively charging material, such as an organic photosensitive member whose main component is positively charging polycarbonate. In concrete terms, the photosensitive drum 20 is configured from a hollow drum with an aluminum cylindrical sleeve as its main body. A photoconductive layer is formed on the outer peripheral surface of the cylindrical sleeve to a predetermined thickness of, for example, about 20 $\mu$m. The photoconductive layer is formed by dispersing a photoconductive resin in polycarbonate.

A charge unit 30 is configured from, for example, a positively charging scorotoron charge unit that generates a corona discharge from a charge wire, which is formed from tungsten for example.

A laser scanner unit 40 includes a laser generator (not shown), a polygon mirror (five surfaced mirror) 41 that is driven to rotate, a pair of lenses 42 and 45, and reflection mirrors 43, 44, and 46. The laser generator generates a laser light L to form an electrostatic latent image on the photosensitive drum 20.

A developing unit 50 includes a case 51 formed with a toner holding chamber 52 serving as a developing agent container and a developing chamber 57. A first agitator 90, a second agitator 91, a cleaning member 54 and a light shielding member 80 are provided in the toner holding chamber 52 in rotation around a common rotational shaft 55. The toner held in the toner holding chamber 52 is a non-magnetic single-component toner that has a positively charging nature and electrically insulating properties. Also, two light transmission windows 56, 56 are provided at the walls of the toner holding chamber 52, one adjacent to each end of the rotational shaft 55.

The developing chamber 57 is positioned beside the toner holding chamber 52 and is in fluid communication therewith through an opening A. A toner supply roller 58 and developing roller 59 are rotatably supported in the developing chamber 57. Further, the photosensitive drum 20 is positioned beside the developing roller 59. A layer thickness regulating blade 64 having a resilient thin shape is disposed in the developing chamber 57, for regulating toner on the developing roller 59 to a predetermined thickness. The toner is then supplied by rotation of the developing roller 59 onto the photosensitive drum 20 to develop the electrostatic latent image on the photosensitive drum 20.

The transfer roller 21 is configured from a resilient foam body having electrical conductivity. The resilient foam body is formed from silicone rubber or urethane rubber, for example, and is rotatably supported. The transfer roller 21 is applied with a voltage, so that the toner image on the photosensitive drum 20 is reliably transferred to a sheet transported between the photosensitive drum 20 and the transfer roller 21.

A fixing unit 70 is provided further downstream in a sheet transport pathway, which extends from the register roller 12 and 13 to a portion where the photosensitive drum 20 and the transfer roller 21 pressingly contact each other. The fixing unit 70 includes a heat roller 71 and a pressing roller 72. The heat roller 71 and the pressing roller 72 press and heat the toner image transferred onto the sheet, thereby fixing the toner image onto the sheet. A pair of transport rollers 73 and a pair of discharge rollers 74 for transporting the sheet are each provided downstream in the sheet transport pathway from the pressing roller 72. A discharge tray 75 is provided downstream from the discharge rollers 74.

It should be noted that the transfer roller 21, the charge unit 30, and the developing unit 50 are housed in a process cartridge 2*a*, which is detachable from the laser beam printer 1. Further, the developing unit 50 is freely detachable from the process cartridge 2*a*, and functions as a developing cartridge.

In the laser beam printer 1 according to the embodiment described above, the surface of the photosensitive drum 20 is uniformly charged by the charge unit 30. Then modulated laser light L is emitted from the laser scanner unit 40 according to image information, to form the electrostatic latent image on the surface of the photosensitive drum 20. The latent image is developed into a visible image by toner from the developing unit 50. The visible image formed on the photosensitive drum 20 is transported toward the transfer position by rotation of the photosensitive drum 20. In the meantime, the sheet supply roller 11 and the register rollers 12 and 13 supply a sheet to the transfer position. The visible toner image on the photosensitive drum 20 is transferred onto the sheet by a transfer bias applied to the transfer roller 21. It should be noted that any toner remaining on the photosensitive drum 20 after transfer is collected into the developing chamber 57 by the developing roller 59. Next, the sheet with the toner image is transported to the fixing unit 70. The sheet is transported between the heat roller 71 and the pressing roller 72 of the fixing unit 70, so that the visible image on the sheet is pressed and heated, and fixed onto the sheet. The sheet is discharged onto the discharge tray 75 by the pair of the transport rollers 73 and the pair of the discharge rollers 74. This completes image formation operations.

Next, the developing cartridge 50 will be described in detail with reference to FIGS. 2 through 7.

Figure 2:
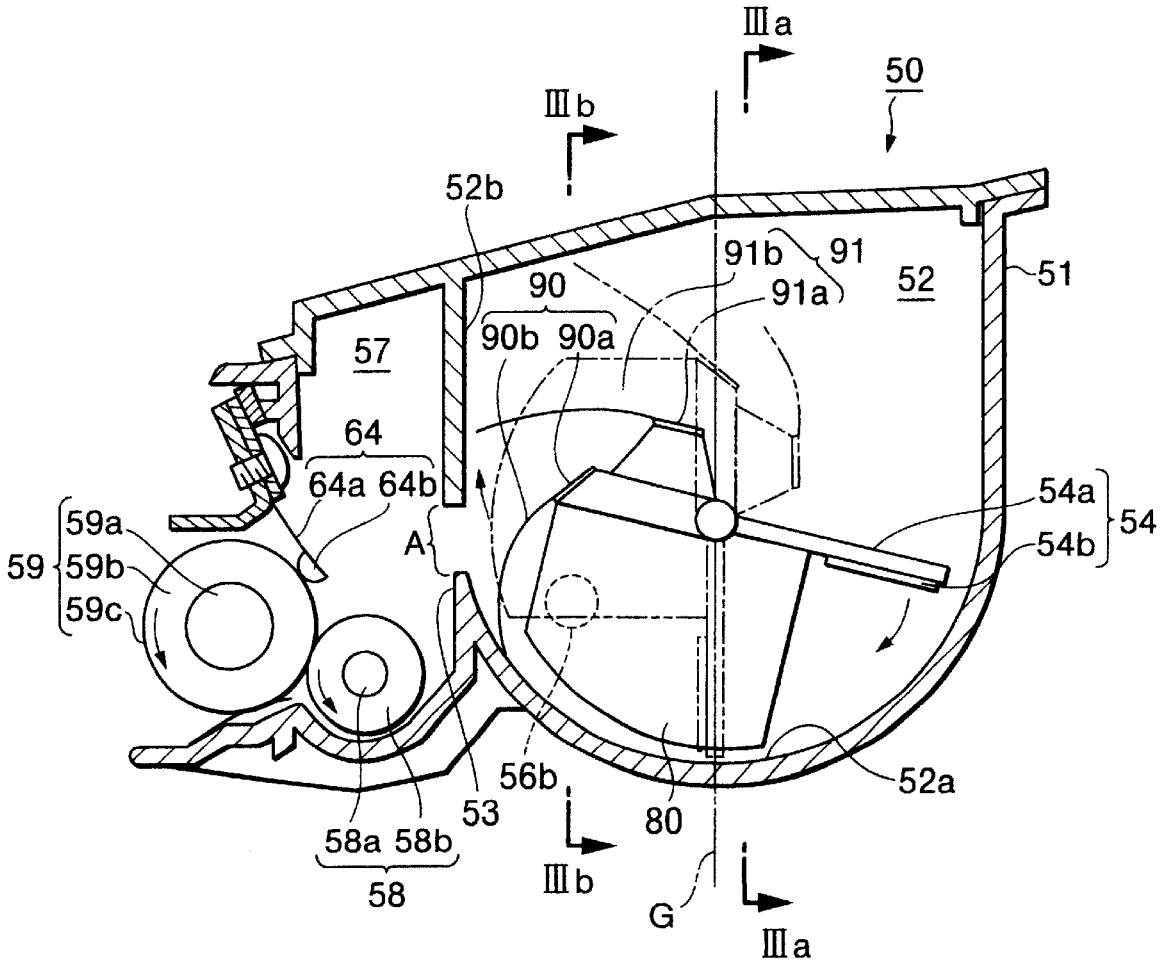
FIG. 2 is a cross-sectional view showing a developing cartridge of the laser beam printer of FIG. 1 and taken along the line II—II of FIG. 3.
Figure 3:
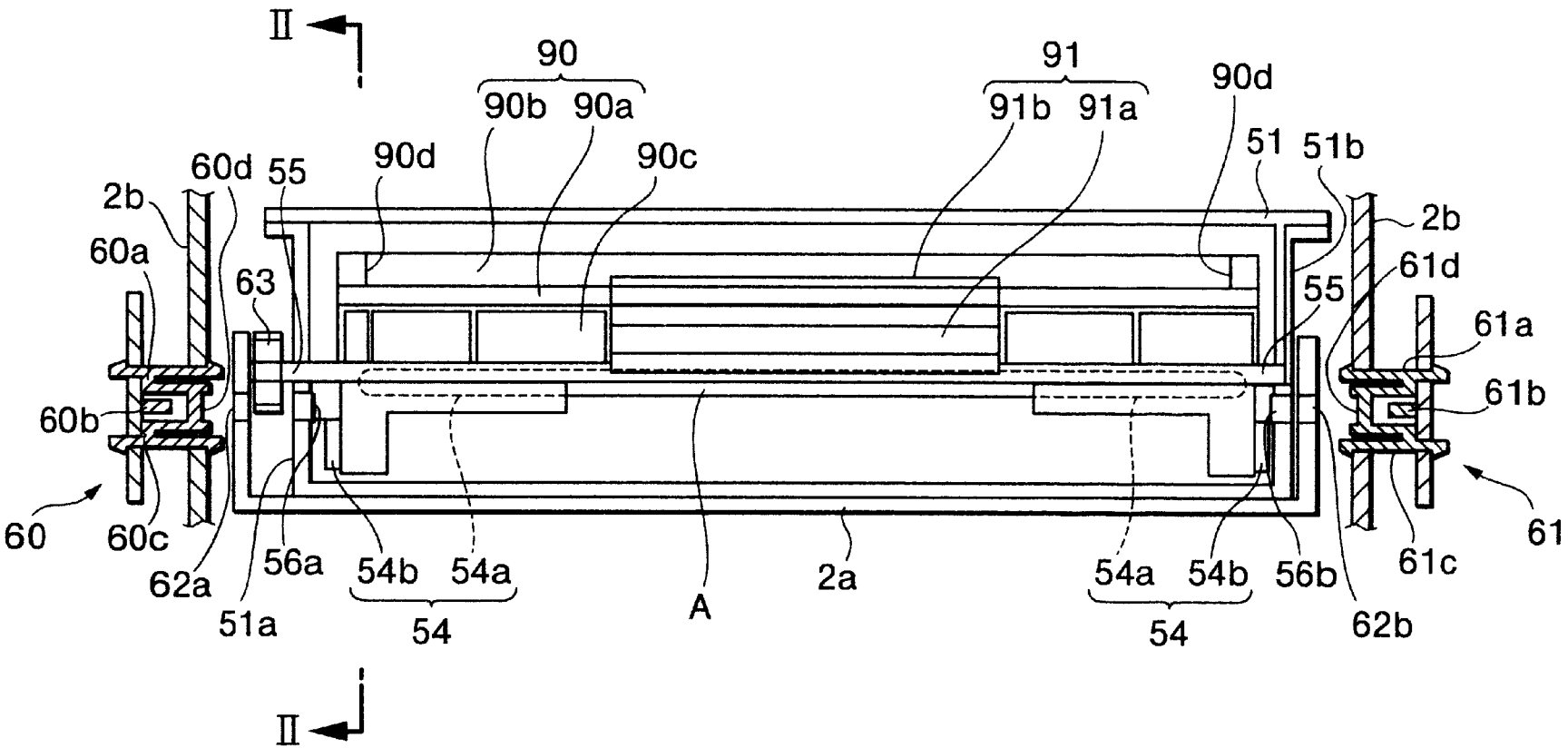
FIG. 3 is a cross-sectional view taken along line III—III of FIG. 2.

FIG. 2 is a cross-sectional view of the developing cartridge 50 taken along the line II—II of FIG. 3, and FIG. 3 is a cross-sectional view taken along the line IIIa—IIIa of FIG. 2 wherein FIG. 3 is a view taken when the first agitator 90 and the cleaning member 54 are positioned as indicated by a two dotted chain line in FIG. 2. Further, FIG. 3 includes a cross-sectional view taken along the line IIIb—IIIb of FIG. 2 for showing a frame 2*b*, a light emitting unit 60, a light receiving unit 61 and support plates 60*b*, 61*b*. The developing cartridge 50 includes a case 51 which forms the toner holding chamber 52 and the developing chamber 57. The case 51 also functions as a frame for supporting various elements so that the developing cartridge 50 can be removed from and mounted to the process cartridge 2a while the various components shown in FIG. 2 are provided within the case 51.

The developing roller 59 serving as a developing agent carrying member includes a metal core 59*a* formed from stainless steel, and a sleeve member 59*b* provided therearound. The sleeve member 59*b* is formed from electrically conductive silicone rubber that includes electrically conductive carbon particles. A coat layer 59*c* formed of rubber or resin containing fluorine is formed on the sleeve member 59*b*. It should be noted that instead of the electrically conductive silicone rubber, electrically conductive urethane rubber is available as a material of the sleeve member 59*b*. Although not shown in the drawings, a power source is provided for applying a predetermined voltage to the developing roller 59 to provide a predetermined potential difference between the developing roller 59 and the photosensitive drum 20.

The layer thickness regulating blade 64 includes a support portion 64*a* and a contact portion 64*b*. The support portion is formed from stainless steel and has its base fixed to the case 51 of the developing cartridge 50. The contact portion 64*b* is fixed on the tip end of the support portion 64*a*, and is formed from electrically insulating or conductive silicone rubber, electrically insulating or conductive fluororubber, or electrically insulating or conductive urethane rubber. The contact portion 64*b* is adapted to press against the developing roller 59 by resilient force of the support portion 64*a*. The contact portion 64*b* according to the present embodiment is formed in a protruding, approximately semi-circular shape in cross-section as shown in FIG. 2. However, the contact portion 64*b* could be formed in a plate shape.

The toner supply roller 58 includes a metal core 58*a* and a cylindrical base member 58*b* formed thereon. The metal core 58*a* is formed from stainless steel for example, and the cylindrical base member 58*b* is formed from an electrically conductive sponge material. The toner supply roller 58 is disposed so as to pressingly contact the developing roller 59 by resilient force of the sponge. It should be noted that other appropriate materials, such as electrically conductive silicone rubber or urethane rubber can be used to form the toner supply roller 58.

The toner contained in the toner holding chamber 52 is a positively chargeable, non-magnetic, single-component toner. The toner base particles have a particle diameter of between 6 microns and 10 microns, and an average particle diameter of 8 microns. The toner base particles are formed by adding a well-known coloring agent, such as carbon black, and a charge control agent, such as nigrosine, triphenylmethane, and quaternary ammonium salt, to styrene acryl resin that has been formed in spheres by suspension polymerization. The toner is configured by adding silica as an outer additive to the surface of the toner base particles. The silica is processed by well-known hydrophobic processes, such as by silane coupling agent, and has an average particle diameter of 10 nm. This silica is added in 0.6% by weight of the toner base particle. Such toner has extremely excellent fluidity, and the toner can be sufficiently charged by friction charging. Therefore, high toner transfer efficiently results, so that extremely high quality images can be formed.

The first agitator 90, which serves as agitating and transferring member, includes a support member 90*a* and a sheet shaped slide contact member or a blade 90*b*, which is attached to the tip end of the support member 90*a*. The support member 90*a* is formed from resin, for example ABS (acrylonitrile butadiene styrene) resin. The slide contact member 90*b* is formed from PET (polyethylene terephthalate) and has a thickness of 75 micron meters. As shown in FIG. 3, the support member 90*a* is formed integrally with a rotational shaft 55 rotatably supported between side walls 51*a*, 51*b* of the case 51. Also, as shown in FIG. 2, the slide contact member 90*b* has a transport surface with a width W1, that is, a length in the rotational radial direction of the rotation shaft 55. With this width W1, as shown in FIG. 2, the slide contact member 90*b* bends when in sliding contact with the toner holding chamber 52, at least with the cylindrically-shaped bottom surface portion 52*a* of the toner holding chamber 52. Also, as shown in FIG. 2, located substantially opposite the bottom surface portion 52*a*, of the toner holding chamber 52, is the upper surface portion 52*b*.

A gear 63 is fixed to one axial end of the rotational shaft 55 so that when rotational drive force from a motor (not shown) is transmitted to the gear 63, the first agitator 90 rotates in the direction indicated by an arrow in FIG. 2. At this time, the slide contact member 90*b* slidingly contacts against the bottom surface portion 52*a* of the toner holding chamber 52 in a bent or flexed condition and pushes toner up into the opening A using the transport surface having the width W1. Incidentally, the opening A is shown by a dotted line and a solid line in FIG.3.

As shown in FIG. 3, slits 90*d*, 90*d* are formed in the slide contact portion 90*b*. Each slit 90*d* is positioned in alignment with each end of the opening A. Thus, a major transport area is provided in the slide contact portion 90*b* between the slits 90*d* and 90*d*. The major transport area can be springingly entered into the opening and splash the toner into the developing chamber 57.

Further, because both the slide contact member 90*b* and the support member 90*a* push the toner upward, opening portions 90*c* are formed in the support member 90*a* as shown in FIG. 3 to decrease resistance received from the toner on the surface of the support member 90*a* during rotation. Also, the support member 90*a* and the slide contact member 90*b* are formed shorter than the case 51. As shown in FIG. 3, the support member 90*a* and the slide contact member 90*b* are separated from the light transmission windows 56*a*, 56*b* by a predetermined distance, so they do not contact the light transmission windows 56*a*, 56*b*.

A second agitator 91 is formed integrally with the support member 90*a* of the first agitator 90, and includes a support member 91*a* and a transport portion or a second blade 91*b*. The support member 91*a* is formed from a resin, such as ABS resin, and rotates in association with rotation of the support member 90*a*. As seen best in FIG. 3, the support member 91*a* is attached at the lengthwise center of the support member 90*a* (widthwise center portion of the toner holding chamber 51). The transport member 91*b* is formed from PET into a sheet shape attached to the support member 91*a*. As the rotational shaft 55 rotates, the transport member 91*b* raises toner in the toner holding chamber 52 upward to the opening A before the sliding contact portion 90*b* does. This configuration has a greater capability to transport toner from the toner holding chamber 52 to the developing chamber 57 in the central portion than at the end portions in the lengthwise direction of the support member 90*a*. Thus, the second agitator 91 serves as means for promoting a transferring efficiency of the developing agent from the developing agent holding chamber to the developing chamber at a lengthwise center portion of the opening higher than the efficiency at lengthwise end portions of the opening A.

As shown in FIG. 3, the cleaning member 54 includes a support member 54*a* and wipers 54*b* provided at each end of the support member 54*a*. The support member 54*a* is formed integrally with the support member 90*a* of the first agitator 90, and the wiper 54*b* is attached to a side edge of the support member 54*a*. The wiper 54*b* is formed from urethane rubber. The support member 54*a* has a phase angle of 180 degrees with the support member 90*a* of the first agitator 90.

The light transmission windows 56 are formed from transparent or opaque materials, for example, acryl, polycarbonate, or polypropylene. As shown in FIG. 3, the light transmission windows 56 include a light transmission window 56*a* and 56*b*. The light transmission window 56*a* is attached to a side wall 51*a* of the case 51 nearer the light generating means 60. The light transmission window 56*b* is attached to a side wall 51*b* of the case 51 nearer the light receiving means 61. Also, as shown in FIG. 3, the light transmission windows 56*a* and 56*b* protrude slightly into the interior of the toner holding chamber 52, so that the wipers 54*b* can surely wipe off the surfaces of the light transmission windows 56*a*, 56*b*. Also, as shown in FIG. 2, the light transmission window 56*b* (56) is positioned nearer the opening A than a plane G, which extends vertically and includes the rotational center axis of the agitator 90 and the cleaning member 54. The plane G will be referred to as the vertical plane G hereinafter. In other words, the toner holding chamber 52 is divided by the vertical plane G into an imaginary first region (left side of the plane G in FIG. 2) and an imaginary second region (right side of the vertical plane G in FIG. 2), and the light transmission windows are positioned in the imaginary first region. Further, as shown in FIG. 3, the process cartridge 2*a* is formed with opening portions 62*a*, 62*b* at positions in alignment with the light transmission windows 56*a*, 56*b*. The opening portion 62*a* enables transmission of light through the light transmission window 56*a* into the toner holding chamber 52, and the opening portion 62*b* enables transmission of light from the light transmission window 56*b* out of the toner holding chamber 52.

As shown in FIG. 3, the light emitting means 60 and the light reception means 61 are positioned on opposite sides of the developing unit 50 in alignment with the light transmission windows 56*a*, 56*b*. The light emitting means 60 is configured from a plastic holder 60*a* attached to the frame 2*b*, a base plate 60*b* supported on the holder 60*a*, and a light emitting element 60*c* provided on the base plate 60*b*. A plastic lens 60*d* is formed integrally with the holder 60*a* in the side facing the light transmission window 56*a*. A light emitting diode is used as the light emitting element 60*c*.

In the same way, the light reception means 61 is configured from a plastic holder 61*a* attached to the frame 2*b*, a base member 61*b* supported on the holder 61*a*, and a light receiving element 61*c* provided on the base member 61*b*. A plastic lens 61*d* is formed integrally with the holder 61*a* in the side facing the light transmission window 56*b*. A phototransistor is used as the light receiving element 61*c*.

As shown in FIG. 3, the above-described light emitting element 60*c*, the plastic lens 60*d*, the opening portion 62*a* of the process cartridge 2*a*, the light transmission window 56*a*, the light transmission window 56*b*, the opening portion 62*b* of the process cartridge 2*a*, the plastic lens 61*d*, and the light receiving element 61*c* are aligned substantially linearly. Light emitted from the light emitting element 60*c* has its rays aligned parallel by the plastic lens 60*d* and falls incident on the light transmission window 56*a* by passing through the opening portion 62*a*. Accordingly, when no toner exists between the light transmission windows 56*a* and 56*b*, light passing through the light transmission window 56*a* falls incident on the light transmission window 56*b* on the other side. The light passes through the light transmission window 56*b* and falls incident on the plastic lens 61*d* after passing through the opening portion 62*b*. The incident light is converged by the plastic lens 61*d* and is received by the light receiving element 61*c*.

Figure 4:
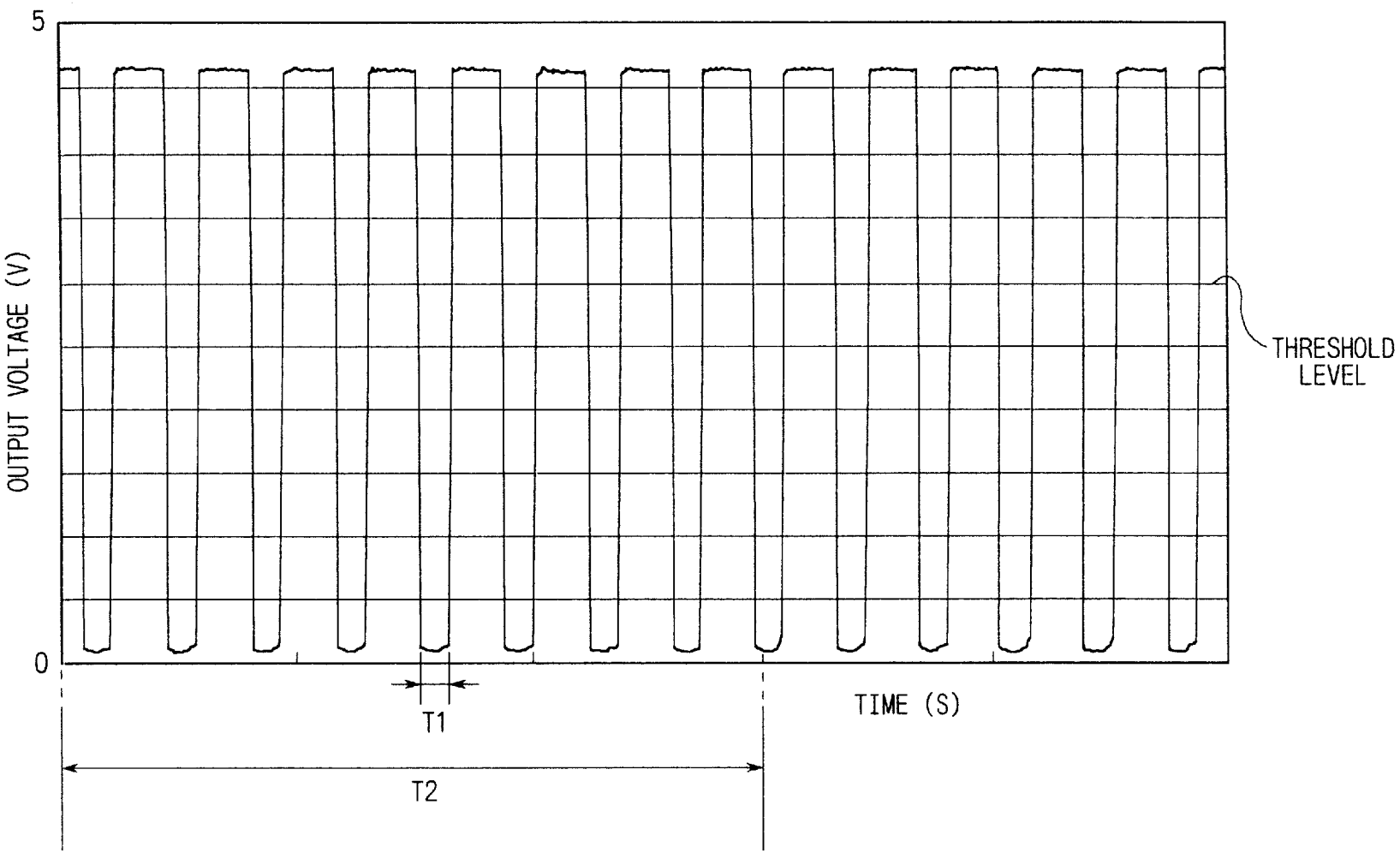
FIG. 4 is a graph representing changes in voltage output from a light receiving element caused by rotation of a wiper that wipes toner off light transmission windows for detecting residual amount of toner.

As shown in FIG. 4, the light receiving element 61*c* outputs a voltage that changes in accordance with the amount of light received by the light receiving element 61*c*. According to the present embodiment, the light receiving element 61*c* outputs a voltage value of approximately 5V when it receives the minimum light amount, and outputs a voltage value of nearly 0V when it receives a maximum light amount. The output voltage value changes within this range according to the received light. In the present embodiment, remaining amount of toner is detected in the following manner. Output from the light receiving element 61*c* described above is read by a control unit such as a microprocessor (not shown) and the like, and judges that output from the light receiving element 61*c* is at a high level when the output voltage value from the light receiving element 61*c* is greater than a predetermined set threshold value, and judges that output from the light receiving element 61*c* is at a low level when the output voltage value from the light receiving element 61*c* is less than the threshold value. The total time of all low level periods T1 during a measured unit period T2 is used to calculate the ratio of low level in the measured unit period T2. Using this calculation, the amount of remaining toner is detected.

As shown in FIG. 2, the light shielding member 80 is a blade shape member provided between the support member 90*a* of the first agitator 90 and the support member 54*a* of the cleaning member 54. The light shielding member 80 is formed from resin, such as ABS resin, and is formed integrally with the first agitator 90, the cleaning member 54, and the rotational shaft 55 so as to rotate around the axial center of the rotational shaft 55 with rotation of the rotational shaft 55. As shown in FIG. 3, the light shielding member 80 is provided only on one end of the rotational shaft 55, that is, the end nearest the light generating means 60.

As shown in FIG. 2, the light shielding member 80 has a sufficient light blocking area that blocks light from the light transmission window 56*b* immediately after the first agitator 90 passes the position of the light transmission window 56*b* (56*a*), and that stops blocking light immediately before the cleaning member 54 starts cleaning the light transmission window 56*b* (56*a*). With this arrangement, even if the toners at or around the light transmission windows 56*b* (56*a*) are transferred by the first agitator 90 the light receiving element 60*c* does not generate output signal because of the blocking of the window by the light shielding member 80. Therefore, detection of the remaining amount of the toner can be accurately performed regardless of the environmental condition and operation period. Further, a simple structure results since the light shielding member 80 is rotatable about the axis of the rotation shaft 55 together with the rotation of the cleaning member 54 and the first agitator 90.

A detailed explanation of operations according to the first embodiment will be described below centered on operations for detecting remaining toner amount, and operations of the first and second agitators 90 and 91 and the cleaning member 54.

Figure 5:
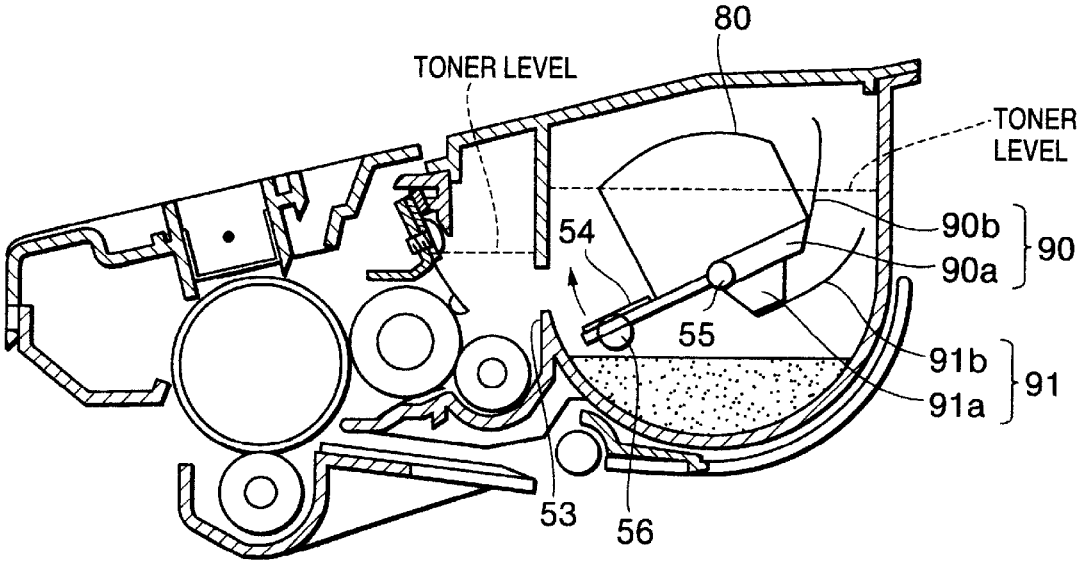
FIG. 5 is a cross-sectional view showing a process cartridge incorporating the developing cartridge of FIG. 3, with a cleaning member rotated into confrontation with a light transmission window.
Figure 6:
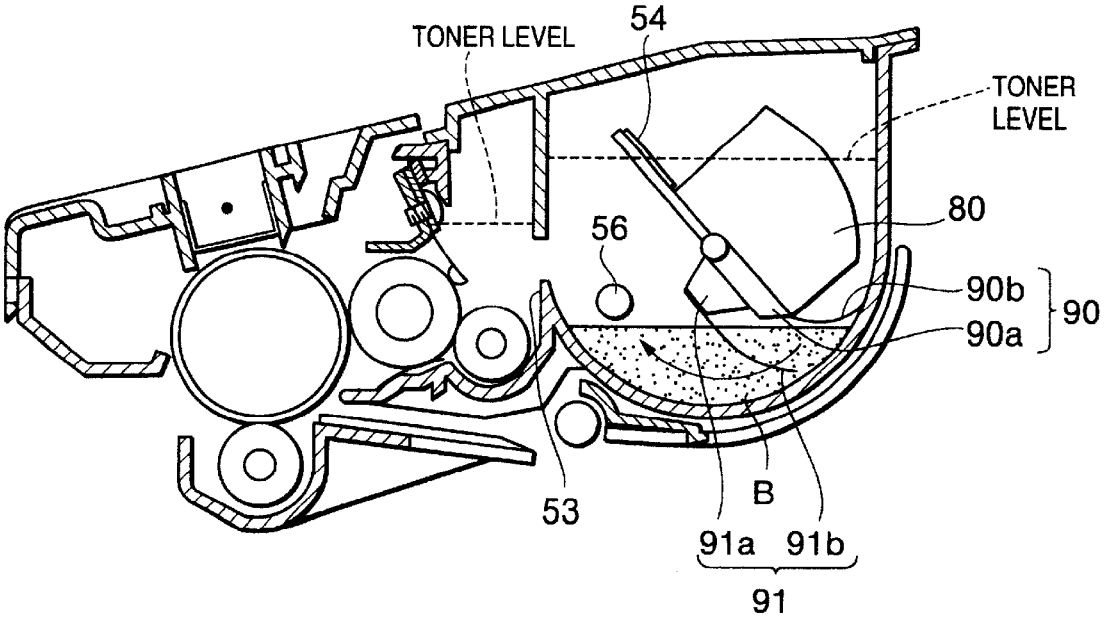
FIG. 6 is a cross-sectional view showing the process cartridge incorporating the developing cartridge of FIG. 3, with the cleaning member rotated past the light transmission window.
Figure 7:
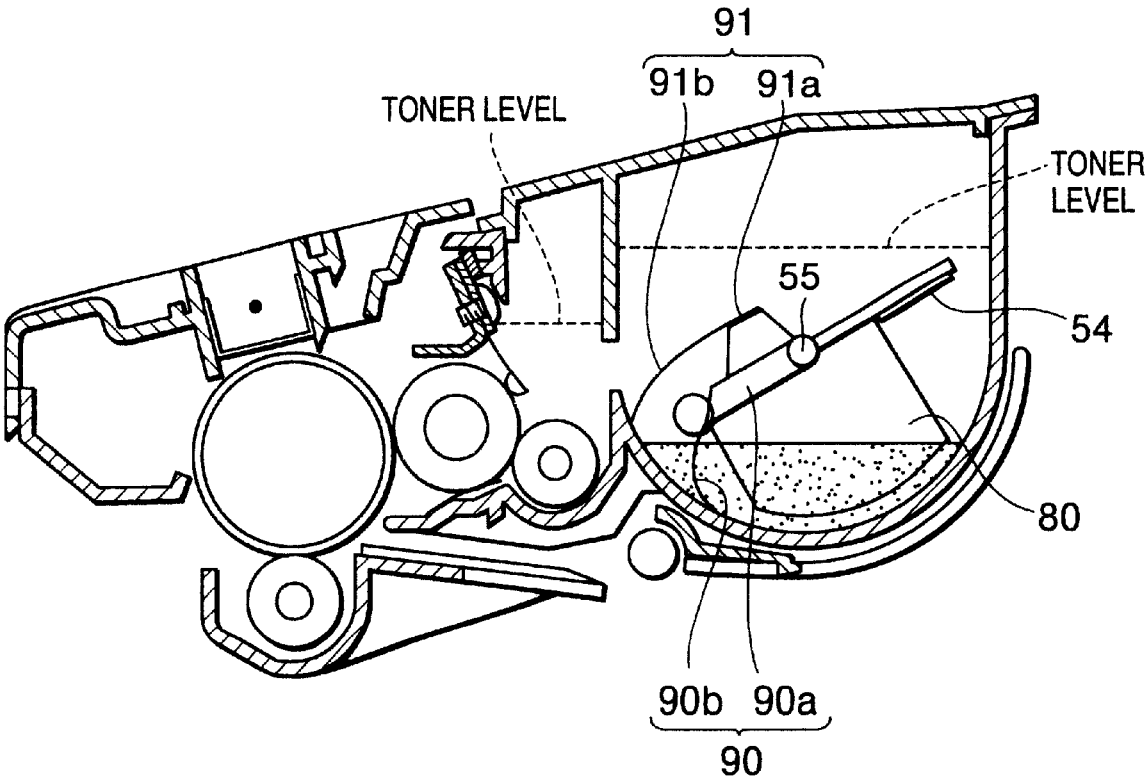
FIG. 7 is a cross-sectional view showing the process cartridge incorporating the developing cartridge of FIG. 3, with a slide contact member of a first agitator being rotated into confrontation with the light transmission window.

First, an explanation will be provided for when toner holding chamber 52 is filled with a sufficient amount of toner, and the level of the toner surface is higher than the light transmission windows 56*a*, 56*b* as indicated by dotted line in FIG. 5. In this case, as shown in FIG. 6, the transport member 91*b* of the second agitator 91 presses toner up toward the opening A before the first agitator 90 presses toner up. Therefore, toner is first pressed up toward the opening A at the widthwise center of the toner holding chamber 52. Next, after the second agitator 91 passes the opening A, then the second agitator 91 transports toner in the widthwise center of the toner holding chamber 52 into the developing chamber 57. At this time, the slide contact member 90*b* of the first agitator 90 pushes up toner from the entire widthwise region of the toner holding chamber 52 while contacting the inner surface of the toner holding chamber 52, and approaches the opening A. Once the slide contact member 90*b* of the first agitator 90 passes the opening A, toner along the entire region in the widthwise direction of the toner holding chamber 52 is transported to the developing chamber 57.

Accordingly, the second agitator 91 first supplies toner to the widthwise center of the developing chamber 57. Immediately afterwards, the first agitator 90 supplies toner across the entire widthwise region of the developing chamber 57. Therefore, pressure at which toner is pressed into the developing chamber is strongest at the widthwise center of the developing chamber 57. The polymerized toner, which is used in this embodiment has extremely high fluidity as described above. When the polymerized toner is pressed with a high pressure at the center, toner at the ends of the developing chamber 57 flows back into the toner holding chamber 52 through the longitudinal ends of the opening A. In other words, the toner circulates from the center to the widthwise ends of the developing chamber 57, that is, in the lengthwise direction of the developing roller 59. Toner can be reliably circulated out even from lengthwise end portions of the developing chamber 57, where toner is consumed in only small amounts by printing. As a result, good printing can be performed without degradation of the toner due to accumulation at the lengthwise end portions of the developing chamber 57 for long periods before being used for printing.

According to experiments, if the second agitator 91 is formed less than ¼ the width of the opening A, then toner does not circulate from the lengthwise center to the lengthwise end portions of the developing chamber 57. Also, if the second agitator 91 is formed greater than ¾ the width of the opening A, then toner stops circulating in the length-wise direction. Experimental results proved that it is desirable for the second agitator 91 to be formed to about ½ the width of the opening A. In the present embodiment, the second agitator 91 is formed to about ⅘ the width of the opening A. In experiments performed for investigating the relationship between the widths of the second agitator 91 and the opening A, a developing unit was prepared by cutting off the top of the toner holding chamber to visually confirm internal toner circulation. Durability tests, such as printing 10,000 sheets were also performed. Upon evaluating the resultant images, print fogging was observed at the edges of the sheets when the second agitator was smaller that ¼ the width of the opening A or when the second agitator was larger than ¾ the width of the opening A. Some slight fogging was observed at the edges of sheets printed during durability tests wherein the second agitator had a width ¼ or ¾ the width of the opening A, but in sufficiently small amounts to enable practical use of such a printer. Also, some toner circulation was observed when new toner was used in a device with a second agitator smaller than ¼ or larger than ¾ the width of the opening A. However, when fluidity of the toner decreased during the durability tests, sometimes the circulation became unstable or stopped altogether. As described above, it was understood that it is desirable to form the second agitator 91 to a width that is ¼ or more, or ¾ or less the width of the opening A.

The configuration of the present embodiment can improve toner circulation without reducing the height of a partition wall 53 shown in FIGS. 1, 2, 5–7, that is, the lower edge of the opening A between the developing chamber 57 and the toner holding chamber 52. Therefore, sufficient toner will always be supplied to the developing roller 59 so that images can be formed with a stable density.

Because the upper edge of the wall 53 of the opening A is higher than an upper end of the toner supply roller 58, the amount of polymerized toner that returns from the development chamber 57 back into the toner holding chamber 52 by gravity is suppressed. Toner will always be supplied in sufficient amounts to the developing roller 59. Furthermore, toner can be properly circulated along the entire width of the development chamber 57, even if the upper edge of the wall 53 of the opening A is high. Therefore, toner can be reliably prevented from dwelling in pockets of the development chamber 57, where it could become old and defective.

Also, because the first agitator 90 is configured to have a length larger than the length of the opening A, toner will always be sufficiently supplied across the entire width of the developing chamber 57. Moreover, because toner is properly circulated along the length of the developing roller 59, unevenness in toner supply will not be generated and line-shaped unevenness in image density will not be generated during printing. Furthermore, the free end of the transport member 91*b* of the second agitator 91 and the free end of the slide contact member 90*b* of the first agitator 90 are configured to penetrate into the developing chamber 57 through the opening A upon release of deformation of the transport member 91*b* and the slide contact member 90*b*. Therefore, toner will be suitably pushed into the developing chamber 57 so that the toner circulation can be improved.

The free end portion of the transport member 91*b* of the second agitator 91 and the slide contact member 90*b* of the first agitator 90 are formed from a resin sheet of PET, and these sheets are formed thicker than 50 μm, because experimental results showed that toner is insufficiently supplied to the developing chamber 57 when the PET sheet is formed thinner than 50 μm. In the illustrated embodiment, the slide contact member 90*b* is formed thicker than 50 μm, and therefore, toner can be sufficiently supplied to the developing chamber 57. Also, the slide contact member 90*b* is formed thinner than 100 μm, otherwise the slide contact member 90*b* generates noise when its deformation is released. It was understood from experimental results that 75 μm is the optimum thickness of the slide contact member 90*b*.

Assuming that the toner is transported more to the widthwise ends than to the widthwise center of the developing chamber 57, then toner supplied from widthwise ends meet at the widthwise center. Unevenness in image density appears at the widthwise center of printed images. On the contrary according to the present embodiment, toner does not collide against itself at the widthwise center, and therefore, unevenness in image density can be reliably prevented.

Incidentally, the toners accumulated near the light transmission windows 56*a*, 56*b* may be transferred by the first agitator 90, since the latter passes nearby the light transmission windows. In this case, if the first agitator 90 is moved from the position shown in FIG. 7 to the position shown in FIG. 2, the light shielding member 80 blocks the light transmission windows 56*a*, 56*b*. Therefore, even if the toner near the windows is transferred by the agitator 90, the light receiving element 61*c* maintain high level output without noise like fluctuation of output signal.

If the remaining amount of the toner is decreased so that the toner level is close to the light transmission windows 56*a*, 56*b* as shown by a solid line in FIG. 5, the light transmission windows 56*a*, 56*b* will not be covered with toners immediately after the wiper 54*b* wipes off the surface of the windows. However, if the wiper 54*b* moves from the position shown in FIG. 5 to the position shown in FIG. 6, the slide contact portion 90*b* of the first agitator 90 also moves, so that the toner is pushed up by the slide contact portion 90*b* in the direction indicated by an arrow B in FIG. 6. Thus, the toner will cover the light transmission windows 56*a*, 56*b*. The period during which the light transmission windows 56*a*, 56*b* is covered with toner by the agitator 90 depends on the amount of toner remaining in the toner holding chamber 52. That is, the more the remaining toner amount, the longer period the light transmission window is shielded by the toner, and vice versa. In other words, the more the remaining toner amount in the container, the shorter the low level period T1 output from the light receiving element 61*c* shown in FIG. 4, and the lesser the remaining toner amount, the longer the low level period T1. According to the present embodiment, a control portion (not shown) samples the output voltage value from the light receiving element 61*c* at a predetermined sampling cycle and stores the sampling values. When the ratio of the total low level period T1 to the pre-determined measuring unit period T2 exceeds a predetermined ratio, a judgment falls "toner empty".

Thus, according to the embodiment, light transmission through and light shielding against the light transmission windows 56*a*, 56*b* is performed by wiping off the surface of the light transmission windows with the wiper 54*b* and by pushing the toner in the toner holding chamber 52 with the first agitator 90. Further, fluctuation of output signal from the light receiving element 61*c* due to the operation of the first agitator 90 can be prevented by shielding the optical path extending between the windows 56*a* and 56*b* with the light shielding member 80 immediately after the first agitator 90 moves past the light transmission windows 56*a*, 56*b*. Consequently, accurate detection of the remaining toner amount can be performed.

Figure 8:
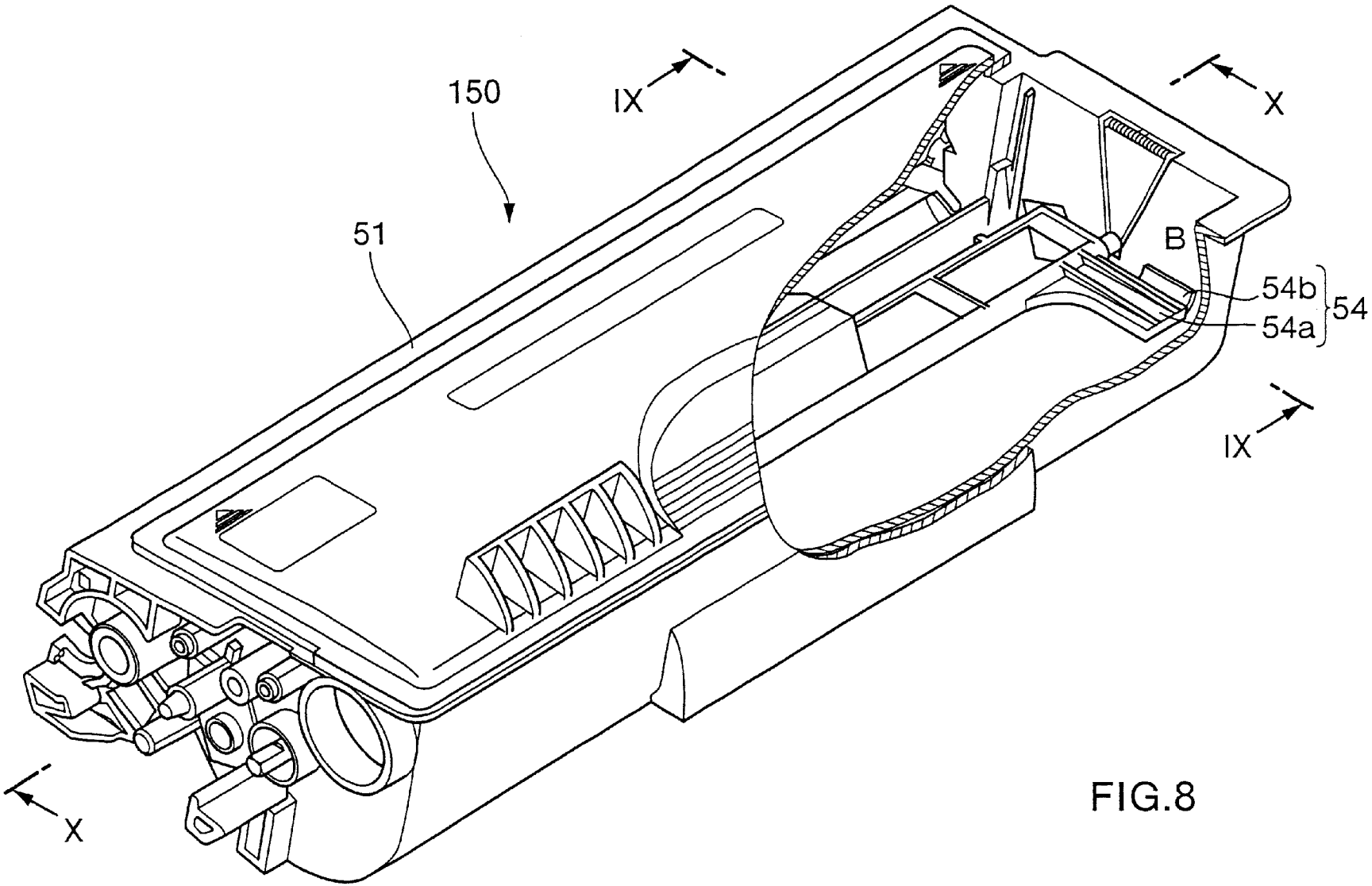
FIG. 8 is a perspective view partially cut away showing a developing cartridge according to a second embodiment of the present invention.
Figure 9:
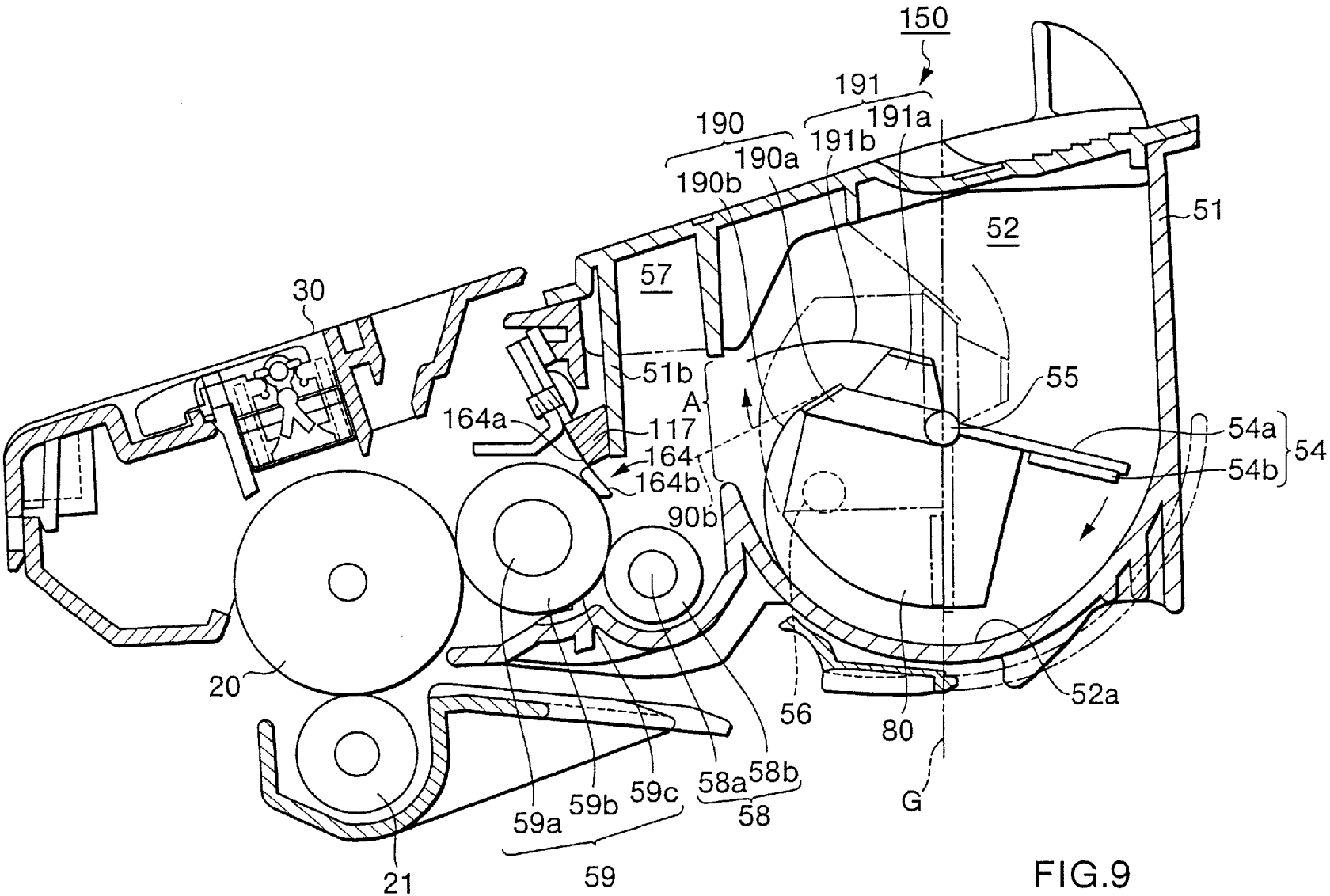
FIG. 9 is a cross-sectional view showing a process cartridge incorporating the developing cartridge of FIG. 8 in which the cross-sectional view of the developing cartridge is taken along the line IX—IX of FIG. 8.
Figure 10:
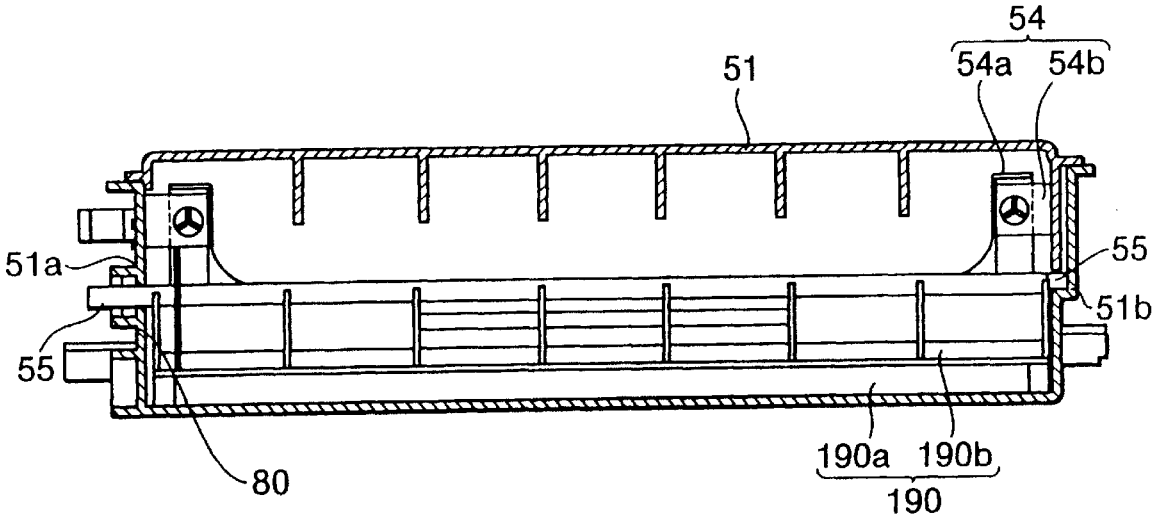
FIG. 10 is a cross-sectional view taken along the line X—X of FIG. 8 showing the developing cartridge according to the second embodiment.

A developing cartridge according to the second embodiment of the present invention will next be described with reference to FIGS. 8 through 14, wherein like parts and components are designated by the same reference numerals as those shown in the first embodiment. The second embodiment uses the developing agent the same as that of the first embodiment. FIG. 8 shows the case 50 of a developing cartridge 150 in which the cleaning member 54 including the support member 54*a* and the wiper 54*b* is provided. FIG. 9 shows a process cartridge including the developing cartridge 150. In the first embodiment, the contact portion 64*b* of the layer thickness regulation blade 64 has a semi-circular cross-section as shown in FIG. 2. In the second embodiment, a contact portion 164 has a semi-oblong cross-section. However, a plate shape is also available for the contact portion. Further, a seal member 117 is provided between the support portion 164*a* and the side wall 51*b* of the case 51 for preventing the toner from being entered into a space above the seal member 117.

Figure 11:
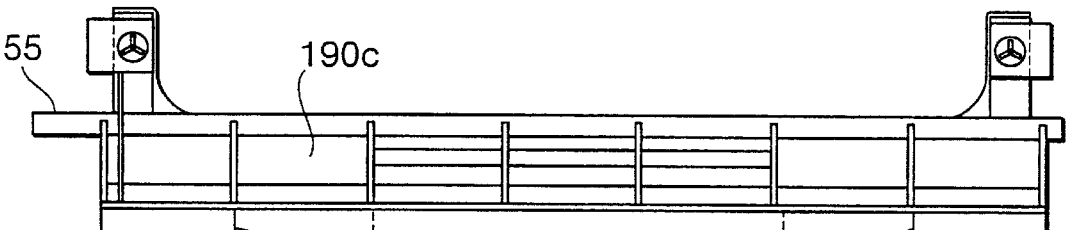
FIG. 11(*a*) is a plan view showing first and second agitators as viewed from an arrow G of FIG. 11(*d*) according to the second embodiment.
Figure 11:
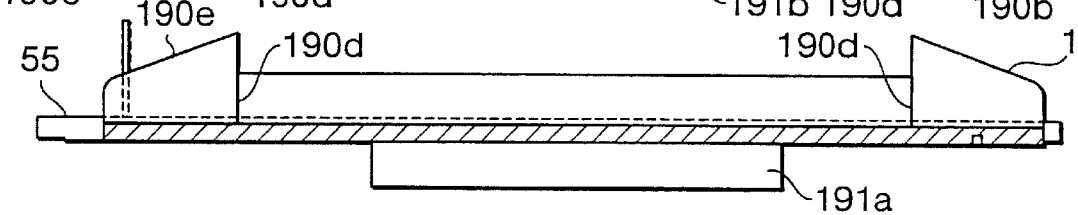
Figure 11:
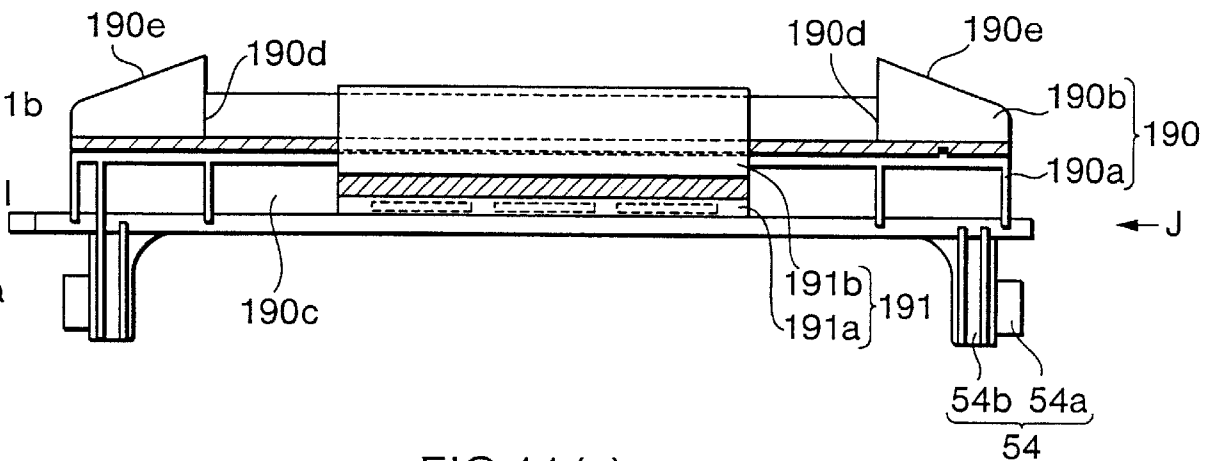
Figure 11:
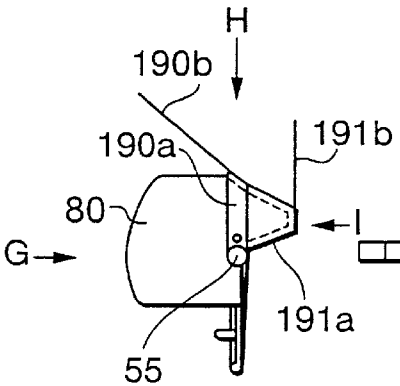

The second embodiment also provides a first agitator 190 and a second agitator 191. As shown in FIG. 9 and 11(*a*) through 11(*d*), the first agitator 190 includes a support member 190*a* and a sheet shaped slide contact member or a blade 190*b*, which is attached to the tip end of the support member 190*a*. The support member 190*a* is formed from resin, for example ABS (acrylonitrile butadiene styrene) resin. As shown in FIGS. 11(*a*) and 11(*c*), the support member 190*a* is formed with a plurality of openings 190*c* so as to reduce a resistance from the toners, because the surface of the support member 190*a* also pushes the toners as well as the slide contact member 190*b* during rotation of the shaft 55.

The slide contact member 190*b* is formed from a sheet like PET (polyethylene terephthalate) and has a thickness of 100 micron meters (0.1 mm). Similar to the first embodiment, the support member 190*a* is formed integrally with a rotational shaft 55 rotatably supported between side walls 51*a*, 51*b* of the case 51. Also, as shown in FIG. 9, the slide contact member 190*b* has a transport surface with a length in the rotational radial direction of the rotation shaft 55. With this length, as shown in FIG. 9, the slide contact member 190*b* bends when in sliding contact with the toner holding chamber 52, at least with the cylindrically-shaped base surface portion 52*a* of the toner holding chamber 52.

A gear(not shown) is fixed to one axial end of the rotational shaft 55 so that when rotational drive force from a motor (not shown) is transmitted to the gear, the first agitator 190 rotates in the direction indicated by an arrow in FIG. 9. At this time, the slide contact member 190*b* slidingly contacts against the base surface portion 52*a* of the toner holding chamber 52 in a bent condition and pushes toner up into the opening A.

Figure 12:
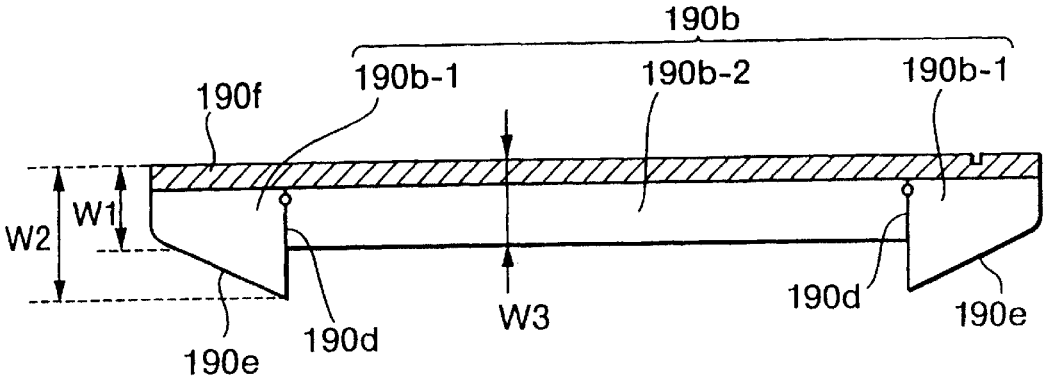
FIG. 12(*a*) is a plan view showing a slide contact portion of the first agitator according to the second embodiment.
Figure 12:
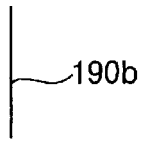

As shown in FIGS. 11 and 12(*a*), the slide contact member 190*b* is formed with slits 190*d*, 190*d* each positioned corresponding to each end of the opening A. The slits 190*d*, 190*d* divide the slide contact member 190*b* into end sections 190*b*-1, 190*b*-1 and an intermediate section 190*b*-2 between the end sections. The slide contact member 190*b* has a base end 190*f* fixed to the support member 190*a*, and each radially free edge 190*e* of the end section 190*b*-1 is symmetrically slanted with respect to an axis of the shaft 55, such that a radial length W1 between the base edge of the base end 190*f* and the free edge 190*e* is gradually increased toward the longitudinal center of the slide contact member 190*b*. Further, a maximum radial length W2 between the base edge of the base end 190*f* and the free edge 190*e* of the end section 190*b*-1 is greater than a radial length W3 at the intermediate section 190*b*-2 as best shown in FIG. 12(*b*).

A second agitator 191 is formed integrally with the support member 190*a* of the first agitator 190, and includes a support member 191*a* and a transport portion or a second blade 191*b*. The support member 191*a* is formed from a resin, such as ABS resin integrally with the support member 190*a*, and rotates in association with rotation of the support member 190*a*. As seen best in FIG. 11(*c*), the support member 191*a* is attached at the lengthwise center of the support member 190*a* (widthwise center portion of the toner holding chamber 51). The transport member 191*b* is formed from PET into a sheet shape attached to the support member 191*a*. As the rotational shaft 55 rotates, the transport member 191*b* raises toner in the toner holding chamber 52 upward to the opening A before the intermediate section 190*b*-2 of the sliding contact portion 190*b* does. This configuration has a greater capability to transport toner from the toner holding chamber 52 to the developing chamber 57 in the central portion than at the end portions in the lengthwise direction of the support member 190*a*.

Figure 13:
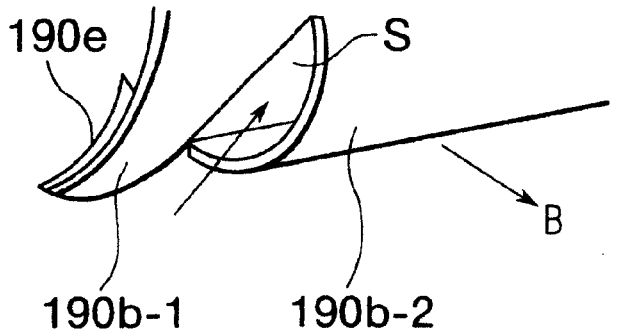
FIG. 13 is an enlarged partial perspective view showing a portion of the first agitator around a slit portion according to the second embodiment.
Figure 14:
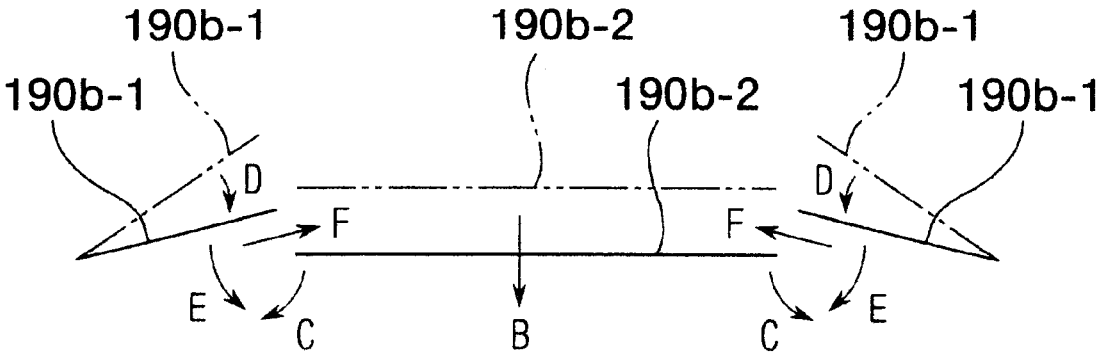
FIG. 14 is a view for description of movement of the slide contact portion according to the second embodiment.

In accordance with the rotation of the shaft 55, the intermediate section 190*b*-2 is moved linearly toward the opening A in a direction indicated by an arrow B in FIGS. 13 and 14. Therefore, the toner in the toner holding chamber 52 is transferred toward the opening A. At the same time, toners at each end of the intermediate section 190*b*-2 are pushed toward the end sections 190*b*-1 as indicated by arrows C in FIG. 14. Further, the slide contact portion 191*b* of the second agitator 191 also pushes the toner toward the developing chamber 59. Furthermore, the toners at each longitudinal end of the slide contact portion 191*b* of the second agitator 191 are also pushed in a direction indicated by an arrow C in FIG. 14 toward the side walls 51*a*, 51*b* of the toner holding chamber 52. In accordance with further rotation of the support member 190*a*, the intermediate section 190*b*-2 is resiliently entered into the opening A as shown by a broken line in FIG. 9, and splashes the toners into the developing chamber 57 because of the resilient deformation of the intermediate section 190*b*-2.

Such first and second agitators 190 and 191 constitute a toner circulation mechanism for circulating the toners from widthwise ends of the toner holding chamber 52 to a center portion thereof, or from the center portion to the widthwise ends. FIGS. 13 and 14 show difference in motion of the end sections 190*b*-1 and the intermediate section 190*b*-2, and FIG. 14 shows contacting positions of the sections 190*b*-1 and 190*b*-2 with respect to the bottom surface of the toner holding chamber 52, the contacting positions being shifted from the two dotted chain line positions to solid line positions in accordance with time elapsing.

More specifically, when the end sections 190*b*-1 and the intermediate section 190*b*-2 are moved deformingly and slidingly with respect to the bottom surface of the toner holding chamber 52, the radially longer portion of the end section 190*b*-1 (i.e., a portion closer to the intermediate section 190*b*-2) and the radially shorter portion of the end section 190*b*-1 (i.e., a portion closer to the side wall 51*a*, 51*b* of the toner holding chamber 52) provide the moving velocity and moving manner different from each other due to the difference in contacting area of these portion with respect to the bottom surface of the toner holding chamber 52. Since the radially longer portion of the end section 190*b*-1 has a contacting area greater than that at the radially shorter portion thereof, the radially longer portion is subjected to resistance greater than that at the radially shorter portion. Therefore, the radially shorter portion is moved faster than the radially longer portion at an initial moving phase. As a result, the contacting line is inclined as shown by two dotted chain line in FIG. 14, and the contacting line will be pivoted in a direction indicated by an arrow D to the solid line position. Due to the above moving mode, a gap S is provided between the end section 190*b*-1 and the intermediate section 190*b*-2 as shown in FIG. 13.

The toners which have been pushed into the arrow C direction will then be pushed back in the direction indicated by an arrows E in FIG. 14 because of the pivotal motion of the free edge portions of the end sections 190*b*-1 in the arrow D direction. Moreover, the toner can also be transferred through the space S in a direction indicated by arrows F from the side ends to the widthwise center portion of the toner holding chamber 52. Further, the toner supplied into the developing chamber 57 by the first and second agitators 190, 191 flows from the widthwise center portion of the developing chamber 57 to each widthwise end thereof, and the surplus toners in the developing chamber 57 can be returned into the toner holding chamber 52 through the opening A. The toners returned at widthwise end portions of the toner holding chamber 52 will then be transferred toward the widthwise center of the toner holding chamber 52 because of the above described end sections 190*b*-1. Thus, efficient toner circulation can be performed.

In this way, according to the second embodiment, the toner accumulated at the widthwise center portion of the toner holding chamber 52 is partly transferred toward the opening A by the second agitator 191 and the intermediate section 190*b*-2 of the first agitator 190, and partly transferred toward the widthwise ends of the toner holding chamber 52, and the toners at the widthwise ends of the toner holding chamber 52 are transferred toward the widthwise center of the toner holding chamber 52 by the end sections 190*b*-1 of the first agitator 190. Further, the toner transferring efficiency at the longitudinal center portion of the agitators 190, 191 is higher than at the longitudinal end portions thereof. Therefore, the toner pushing force into the developing chamber 57 at the widthwise center portion of the developing chamber 57 is greater than that at the widthwise end portions thereof. Thus, the toner pushed into the developing chamber 57 is moved toward the widthwise end portions of the developing chamber 57 and is returned to the toner holding chamber 52 from the widthwise end portions. In this way, the toner circulation in the widthwise direction of the developing chambers 57 and the toner holding chamber 52 occurs in both the toner holding chamber 52 and the developing chamber 57.

This toner circulating direction is the longitudinal direction of the agitators 190, 191. Accordingly, reduction in fluidity of the toner can be avoided, and toner stay at the widthwise end portions of these chambers can be prevented thereby avoiding degradation of the toner. Consequently, printing quality in the axial direction of the developing roller can be uniformly maintained. Moreover, since the opening A extends over a length of the toner supply roller 58, shortage of toner supply to the developing roller can be avoided.

While the invention has been described in detail and with reference to specific embodiments thereof, it would be apparent to those skilled in the art that various changes and modifications may be made therein without departing from the sprit and scope of the invention.

Figure 15:
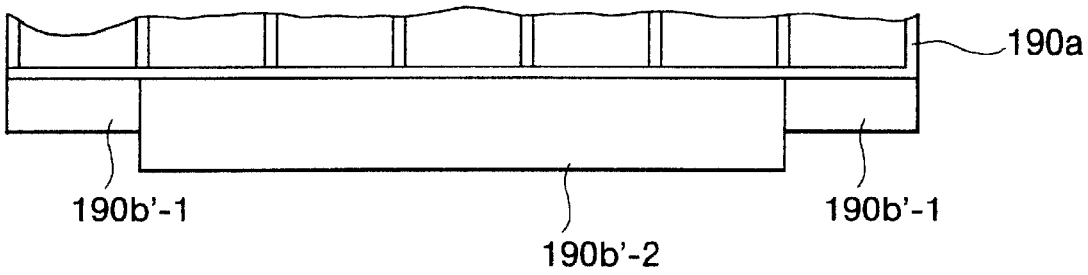
FIG. 15 is a plan view showing a part of a developing agent transferring unit according to a first modification.
Figure 16:
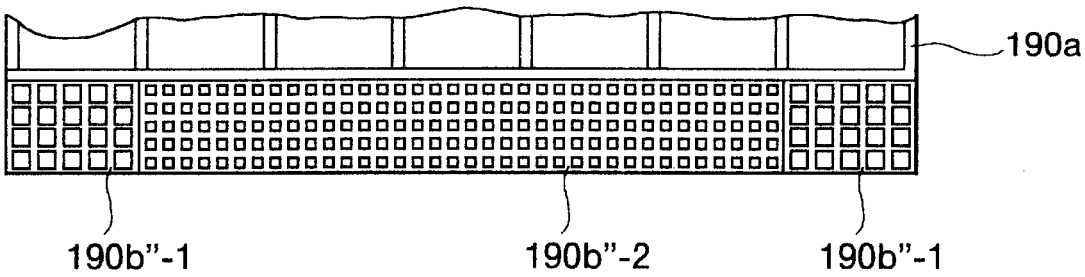
FIG. 16 is a plan view showing a part of a developing agent transferring unit according to a second modification.

For example, the above embodiment provides the second agitator 91, 191 to strengthen supply of toner to the widthwise center of the developing roller 59. However, various modifications may be conceivable to this effect. For example, more agitators can be provided in the widthwise center. Also, there is no need to provide a plurality of agitators. For example, a single agitator can be provided with a radial length, that is, the length from the rotational axis to the free end of the sliding contact portion longer at the widthwise center 190*b*'-2 than at the widthwise ends 190*b*'-1 as shown in FIG. 15. Alternatively, a single agitator can be provided with the surface of the sliding contact portion machined in a mesh, wherein the mesh is more open at the widthwise ends 190*b*"-1 than at the widthwise center 190*b*"-2 as shown in FIG. 16.

Further, in the second embodiment, two slits 190*d* are formed at the slide contact member 190*b* of the first agitator 190. However, the more than two slits can be formed in the slide contact member 190*b*. Further, in the second embodiment, only two end sections 190*b*-1 have slanted free ends 190*e*. However, the numbers of the slanted free ends can be increased if the numbers of slits is increased.

Further, in the second embodiment, the second agitator 191 can be dispensed with as far as the first agitator 190 has at least two end sections 190*b*-1 and at least one intermediate section 190*b*-2 as shown in FIG. 12(*a*) for providing toner circulation in the lengthwise direction of the first agitator.

Further, in the above described embodiment, the developing cartridge 50 is detachably mounted on the process cartridge 2*a*, and the process cartridge 2*a* is detachably mounted on the image forming device. However, the developing unit can be non-removably installed in the process cartridge, and the process cartridge can be non-removably installed in the image forming device.

What is claimed is:

1. A developing cartridge, comprising:

a developing housing;

a developing agent container holding therein a developing agent, the developing agent container being connected to and positioned beside the developing housing and formed with an opening in communication with the developing housing, the opening having a length in a widthwise direction of an image recording sheet; and a developing agent agitating and transferring member rotatably disposed in the developing agent container about a rotation axis for agitating the developing agent in the developing agent container and transferring the developing agent to the developing housing, the developing agent agitating and transferring member comprising means for promoting a transferring efficiency of the developing agent from the developing agent container to the developing housing at a lengthwise center portion of the opening higher than the efficiency at lengthwise end portions of the opening.

2. The developing cartridge as claimed in claim 1, wherein the developing agent agitating and transferring member comprises a first blade rotatable about the rotation axis and having a length equal to or greater than the length of the opening and positioned in alignment with the opening;

and wherein the promoting means comprises a second blade also rotatable about the rotation axis and having a length smaller than the length of the first blade and positioned at the lengthwise center of the opening.

3. The developing cartridge as claimed in claim 2, wherein the first blade has a first free end and the second blade has a second free end, the first free end and the second free end being insertable through the opening into the developing housing.

4. The developing cartridge as claimed in claim 2, wherein the first blade and the second blade are in the form of flexible resin sheet having a thickness ranging from 50 to 100 micron meters.

5. The developing cartridge as claimed in claim 2, further comprising:

a developing agent carrying member disposed in the developing housing; and a developing agent supplying member disposed in the developing housing and positioned between the opening and the developing agent carrying member for supplying the developing agent transferred through the opening to the developing agent carrying member, the developing agent supplying member having an upper end; and wherein the opening has a lower end face higher than the upper end of the developing agent supplying member.

6. The developing cartridge as claimed in claim 2, wherein the length of the second blade is in a range of from ¼ to ¾ the length of the opening.

7. The developing cartridge as claimed in claim 1, wherein the second blade is positioned forwardly of the first blade in a rotating direction of these blades.

8. The developing cartridge as claimed in claim 1, wherein the developing agent comprises polymerized toner produced by a polymerization method.

9. The developing cartridge as claimed in claim 1, wherein the developing agent agitating and transferring member comprises:

a center shaft rotatable about its axis and provided in the developing agent container and extending in the widthwise direction of the image recording sheet;

a support member fixed to the center shaft and extending in the widthwise direction of the image recording sheet;

a flexible blade having a base end fixed to the support member and a free end in flexible deforming contact with an inner surface of the developing agent container, the flexible blade serving as the circulation means and comprising:

end blade sections each having a base end fixed to each longitudinal end of the support member, and having free end in flexible deforming contact with the inner surface of the developing agent container, each free end being slanted with respect to the support member in such a manner that a radial length between the base end and the free end is gradually increased from a longitudinal end toward a longitudinal center of the support member; and an intermediate blade section positioned between the end blade sections and having a base end fixed to the support member and a free end, each end section having a maximum radial length at a side closest to the intermediate blade section, the intermediate section having a radial length between the base end and the free end smaller than the maximum radial length.

10. The developing cartridge as claimed in claim 9, further comprising a developing agent supplying member disposed in the developing housing and extending in the widthwise direction of the image recording sheet, the opening being open to an entire length of the developing agent supplying member.

11. The developing cartridge as claimed in claim 10, wherein the developing agent agitating and transferring member further comprises a second flexible blade fixed to the center shaft and at a position spaced away from and in superposed relation with the intermediate blade section, the second flexible blade having a length smaller than a length of the intermediate blade section.

12. The developing cartridge as claimed in claim 11, wherein the end blade sections have radial lengths that allow the free ends of the end blade sections to enter through the opening into the developing housing.

13. The developing cartridge as claimed in claim 9, wherein the developing agent comprises polymerized toner produced by a polymerization method.

14. The developing cartridge as claimed in claim 1, wherein the developing agent container includes a container wall and, the developing cartridge further comprising a light transmission window provided at the container wall to permit a detection light to pass through the light transmission window so as to detect an amount of the developing agent in the developing agent container.

15. The developing cartridge as claimed in claim 14, further comprising a cleaning member disposed in the developing agent container and rotatable at a constant angular velocity about the rotation axis in a direction to move upward when passing beside the opening, the cleaning member being movable to a cleaning position in sliding contact with the light transmission window for cleaning the light transmission window.

16. The developing cartridge as claimed in claim 15, wherein the developing agent container defines therein a the developing agent accumulation space, the accumulation space being divided into an imaginary first region and an imaginary second region by an imaginary vertical plane passing through the rotation axis and extending in an axial direction of the rotation axis, the imaginary first region being in communication with the opening, and the imaginary second region being positioned opposite the opening with respect to the imaginary vertical plane, the light transmission window being positioned in the imaginary first region.

17. The developing cartridge as claimed in claim 16, wherein the developing agent agitating and transferring member comprises a first blade rotatable about the rotation axis and having a length equal to or greater than the length of the opening and positioned in alignment with the opening;

and wherein the promoting means comprises a second blade also rotatable about the rotation axis and having a length smaller than the length of the first blade and positioned at the lengthwise center of the opening, the first blade being rotatable about the rotation axis at a constant angular velocity equal to an angular velocity of the cleaning member, the first blade being spaced away from the cleaning member in such a manner that the first blade is positioned in the imaginary second region when the cleaning member is in the imaginary first region.

18. The developing cartridge as claimed in claim 17, further comprising a light shielding member provided in the developing agent container and rotatable about the rotation axis and positioned between the first blade and the cleaning member.

19. The developing cartridge as claimed in claim 18, wherein the light shielding member is angularly spaced away from the first blade, and is positioned rearwardly of the first blade in the direction of rotation of the first blade and the light shielding member.

20. The developing cartridge as claimed in claim 1, wherein the developing agent agitating and transferring member comprises a flexible blade extending in the lengthwise direction of the opening, the flexible blade comprising a center section at a lengthwise center portion thereof and end sections at lengthwise end portion thereof, the center section having a first radial width in a radial direction extending from the rotation axis and the end sections having a second radial width smaller than the first radial width, whereby the center section serves as the promoting means.

21. The developing cartridge as claimed in claim 1, wherein the developing agent agitating and transferring member comprises a flexible blade extending in the lengthwise direction of the opening, the flexible blade comprising a center section at a lengthwise center portion thereof and formed with a first kind of mesh, and end sections at lengthwise end portion thereof and formed with a second kind of mesh, a mesh size of the first kind of mesh being smaller than that of the second kind of mesh, whereby the first section serves as the promoting means.

22. A process cartridge comprising:

a casing;

an electrostatic latent image carrying member disposed in the casing; and a developing cartridge as defined in claim 1, the developing cartridge being detachable with respect to the casing.

23. An image forming device including a process cartridge as defined in claim 22.

24. The developing cartridge as claimed in claim 1, wherein the promoting means also serves as circulation means for circulating the developing agent in the developing agent container in the widthwise direction thereof.

25. A developing cartridge comprising:

a developing housing;

a developing agent container holding therein a developing agent, the developing agent container being connected to and positioned beside the developing housing and formed with an opening in communication with the developing housing, the opening having a length in a widthwise direction of an image recording sheet; and a developing agent agitating and transferring member for agitating the developing agent in the developing agent container and transferring the developing agent to the developing housing, developing agent agitating and transferring member comprising:

a center shaft rotatable about its axis and provided in the developing agent container and extending in the widthwise direction of the image recording sheet;

a support member fixed to the center shaft and extending in the widthwise direction of the image recording sheet;

a flexible blade having a base end fixed to the support member and a free end in flexible deforming contact with an inner surface of the developing agent container, the flexible blade comprising:

end blade sections each having a base end fixed to each longitudinal end of the support member, and having free end in flexible deforming contact with the inner surface of the developing agent container, each free end being slanted with respect to the support member in such a manner that a radial length between the base end and the free end is gradually increased from a longitudinal end toward a longitudinal center of the support member; and an intermediate blade section positioned between the end blade sections and having a base end fixed to the support member and a free end, each end blade section having a maximum radial length at a side closest to the intermediate blade section, the intermediate blade section having a radial length between the base end and the free end smaller than the maximum radial length.

26. The developing cartridge as claimed in claim 25, further comprising a developing agent supplying member disposed in the developing housing and extending in the widthwise direction of the image recording sheet, the opening being open to an entire length of the developing agent supplying member.

27. The developing cartridge as claimed in claim 26, wherein the developing agent agitating and transfer member further comprises a second flexible blade fixed to the center shaft and at a position spaced away from and in superposed relation with the intermediate blade section, the second flexible blade having a length smaller than a length of the intermediate blade section.

28. The developing cartridge as claimed in claim 27, wherein the end blade sections have radial lengths that allow the free ends of the end blade sections to enter through the opening into the developing housing.

* * * * *